US005722377A

United States Patent [19]

Schoenfeld et al.

[11] Patent Number: 5,722,377

[45] Date of Patent: Mar. 3, 1998

[54] FUEL INJECTION METHOD AND SYSTEM

[75] Inventors: Dieter Schoenfeld, Markdorf, Germany; Bernhard Baechle, Kuala Lumpur, Malaysia

[73] Assignee: MTU Motoren-und Turbinen-Union Friedrichshafen GmbH, Friedrichshafen, Germany

[21] Appl. No.: 721,037

[22] Filed: Sep. 26, 1996

[30] Foreign Application Priority Data

Sep. 26, 1996 [DE] Germany ..... 195 35 703.5

[51] Int. Cl.[6] ..... F02M 37/04

[52] U.S. Cl. ..... 123/575; 123/25 C

[58] Field of Search ..... 123/299, 300, 123/575, 576, 577, 578, 25 C, 276 GE

[56] References Cited

U.S. PATENT DOCUMENTS

| | | | |
|---|---|---|---|
| 3,749,097 | 7/1973 | Grow | 123/575 |
| 3,807,377 | 4/1974 | Hirschler | 123/575 |
| 3,851,633 | 12/1974 | Shih | 123/575 |
| 4,392,466 | 7/1983 | Mowbray | 123/299 |
| 4,499,861 | 2/1985 | Wiegand | 123/299 |
| 4,693,227 | 9/1987 | Satou | 123/300 |
| 5,092,305 | 3/1992 | King | 123/575 |
| 5,170,751 | 12/1992 | Tosa | 123/299 |
| 5,174,247 | 12/1992 | Tosa | 123/575 |
| 5,438,966 | 8/1995 | Teegen | 123/299 |

FOREIGN PATENT DOCUMENTS

| | | | |
|---|---|---|---|
| 0048771 | 3/1983 | Japan | 123/575 |

*Primary Examiner*—Carl S. Miller

*Attorney, Agent, or Firm*—Evenson, McKeown, Edwards & Lenahan, P.L.L.C.

[57] ABSTRACT

A fuel injection method and system for a Diesel engine, with an injection nozzle (1) supplied with a first fuel through a high-pressure pump (3) through a reservoir (2), wherein the engine can operate—rather than with the first fuel—with the second fuel in the form of pure fuel or of an emulsion of fuel and another substance that is insoluble in the fuel. Means are provided by which the second fuel is guided in a circuit through injection nozzle (1) and the second fuel, when the injection nozzle is actuated, is injected into the engine through the first fuel, which is under high pressure, from reservoir (2) to injection nozzle (1), with the mixture ratio of the fuel and additional substance in the second fuel being adjusted in the circuit.

21 Claims, 1 Drawing Sheet

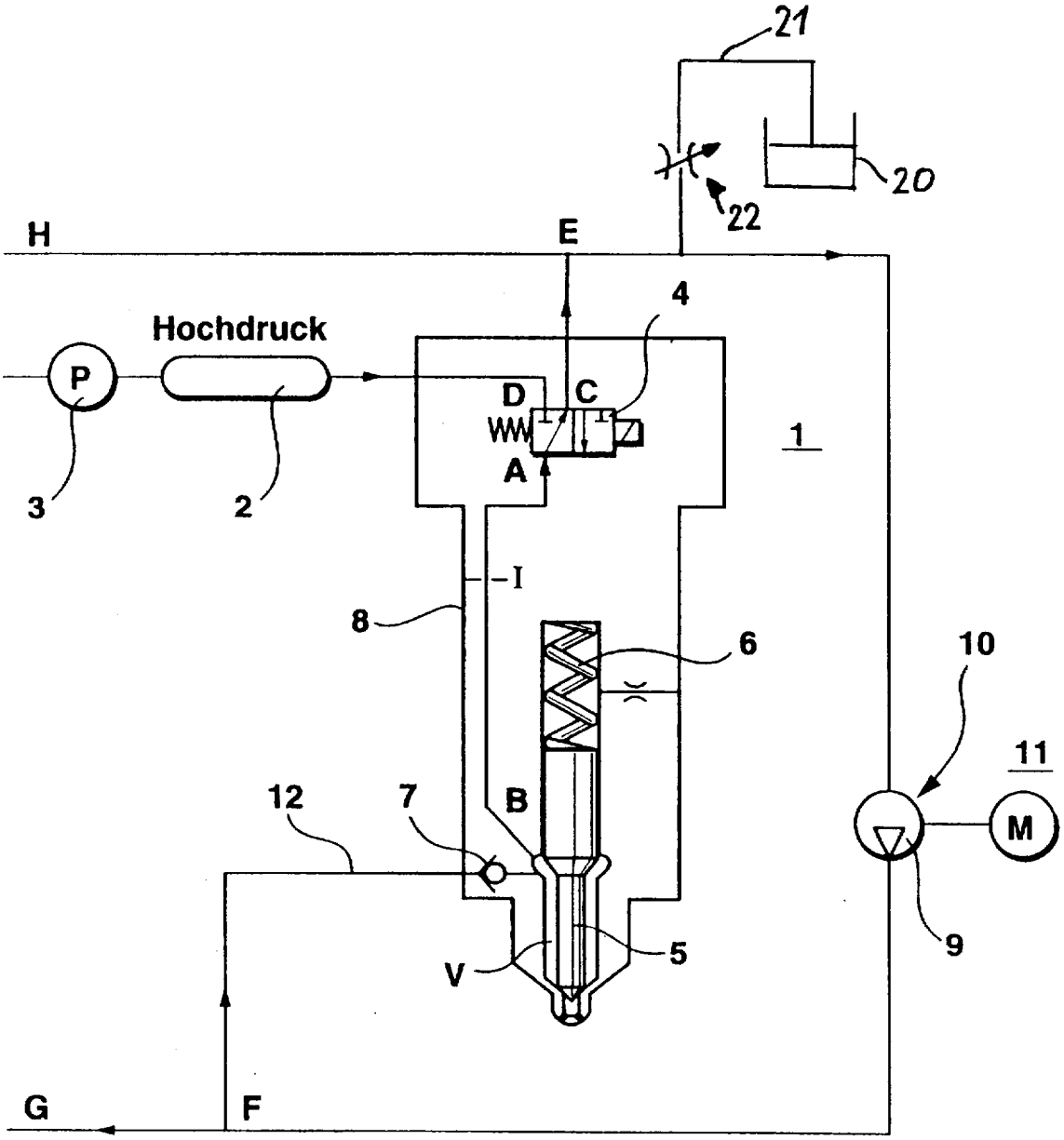
21
20
22
H
E
4
Hochdruck
P
D
C
A
1
3
2
I
8
6
10
11
12
7
B
M
9
V
5
G
F

FUEL INJECTION METHOD AND SYSTEM

BACKGROUND AND SUMMARY OF THE INVENTION

The present invention relates to a fuel injection method for a Diesel engine with an injection nozzle supplied with a first fuel by a high-pressure pump through a reservoir, said nozzle having an internal volume into which the fuel is conducted, wherein the engine can operate—rather than with the first fuel—with a second fuel in the form of pure fuel or an emulsion of fuel and another substance that is insoluble in the fuel. The invention also relates to a fuel injection system for a Diesel engine in which such a fuel injection method is used.

One important way to reduce exhaust emissions, especially of oxides of nitrogen, and to reduce the specific fuel consumption of Diesel engines, especially large Diesel engines, comprises operating the engine with an emulsified fuel. This is a form of fuel in which the fuel and another substance that is insoluble in the fuel occur in an emulsion, for example water and Diesel fuel, water and heavy oil, or methanol and Diesel fuel, with an emulsion of water and light or heavy Diesel oil being used most frequently. One disadvantage of operation using an emulsified fuel results from the fact that during a prolonged pause in the operation of the engine, the two components of the emulsion, which are not soluble in one another, separate, so that next time the engine is started, only water is injected instead of the emulsion and thus the starting characteristics of the engine are affected highly adversely.

Another disadvantage of operation with emulsified fuel is that, because of the very fine water droplets present in the emulsion, the lifetime of the injection pump is shortened by corrosion and reduced lubrication.

Fuel injection systems in which fuel is pumped continuously into a reservoir by a high-pressure pump and the fuel is removed from this reservoir discontinuously by the injection nozzles of the engine in accordance with the injection process, so-called common rail systems, are seeing increased application. An important advantage of such common rail systems consists of their free selectability of the beginning and end of the injection process.

A goal of the invention is to provide a fuel injection method for operating a Diesel engine with an emulsified fuel that guarantees reliable restarting characteristics of the engine after a prolonged shutdown and a low wear of the injection system, as well as a corresponding fuel injection system.

This and other goals have been achieved by providing a fuel injection method in which the second fuel is conducted in a circuit through the internal volume of the injection nozzle and in which the second fuel, when the injection nozzle is actuated, is injected through the first (emulsified) fuel which is under high pressure and has been delivered from the reservoir, into the internal volume of the injection nozzle, whereupon the mixing ratio of the fuel and the other material in the second fuel is adjusted in the circuit.

This and other goals have also been achieved by providing a fuel injection system in which the injection nozzle comprises means by which the second fuel is guided in a circuit through the internal volume of the injection nozzle, and when the injection nozzle is actuated, it is injected into the engine through the first fuel, which is under high pressure, and is delivered into the internal volume of the injection nozzle, and in which means are provided through which circulation of the second fuel through the injection nozzle is maintained and the mixing ratio of the fuel and the material in the second fuel that is insoluble with respect to the fuel is adjusted.

One important advantage of the fuel injection method and system according to the present invention is that it is possible to use pure fuel alone for starting the Diesel engine, since the mixing ratio of the fuel and the additional substance that is insoluble in the second fuel changes very rapidly in this circuit and can be adapted to the respective operating states of the engine. Therefore it is also possible before shutting down the Diesel engine when it is operating on emulsified fuel to switch briefly to operation with pure fuel so that the fuel injection system of the engine is filled completely with pure fuel during the operating pause and is thus protected against corrosion.

These and other objects, features and advantages of the present invention will become more readily apparent from the following detailed description when taken in conjunction with the accompanying drawings.

BRIEF DESCRIPTION OF THE DRAWINGS

The sole drawing FIGURE shows a schematic block diagram of a fuel injection system for a Diesel engine, according to one preferred embodiment of the present invention.

DETAILED DESCRIPTION OF THE DRAWINGS

In the fuel injection system shown in the FIGURE, an injection nozzle 1 is supplied from a reservoir 2 with a first fuel that is pressurized by high-pressure pump 3. Injection nozzle 1 contains a solenoid valve 4 from which a channel A-B runs to an injector volume V surrounding nozzle needle 5 at the end of injection nozzle 1. Nozzle needle 5 is pressed against its valve seat by an injection valve spring 6.

When solenoid valve 4 is opened at the beginning of the injection process, a connection is created between points A and D at solenoid valve 4 so that a path is cleared for the first fuel from reservoir 2 through solenoid valve 4 to injector volume V. At the same time, when solenoid valve 4 is opened at the beginning of the injection process, as a result of the change in the pressure ratios in injection nozzle 1, nozzle needle 5 is caused in a known way to lift off its valve seat and the fuel present in injector volume V is sprayed through channel A-B into the Diesel engine, due to the fuel delivered from reservoir 2. At the end of the injection process, closing solenoid valve 4 breaks the connection between points A and D and the action of injection valve spring 6 presses nozzle needle 5 back onto its valve seat and injection nozzle 1 is closed.

To this extent, the fuel injection system just described corresponds to a known common rail system, with only one injection nozzle 1 shown in the FIGURE for the sake of improved clarity. In fact, a number of injection nozzles are provided that correspond to the number of cylinders in the engine.

According to the invention, means are provided by which a second fuel, consisting either of pure fuel or of an emulsion of fuel and another substance that is insoluble in the fuel, can be guided in a circuit through the inner volume of injection nozzle 1 that consists of injector volume V and channel A-B.

For this purpose, solenoid valve 4 is designed as a two-way valve that can open up a flow path A-C as an alternative to flow path A-D. From point C on solenoid valve 4, a line connection runs through points E and F to a supply channel 12 that terminates in injector volume V. Line connection E-F contains a pump 9 with means 10 for admixing water, through which the abovementioned emulsion for the second fuel can be created. Pump 9 is driven through a rotary drive by Diesel engine 11, which is schematically shown.

A check valve 7 is provided in supply channel 12 to inject a volume V, by which valve supply channel 12 is closed during the injection process because of the high pressure that is then applied, and the circuit for the second fuel is thus separated from the internal volume of injection nozzle 1. Connections run from points H and G of the circuit for the second fuel to additional, similarly designed injection nozzles 1 of the Diesel engine.

During operation of the fuel injection system, connection A-D in solenoid valve 4 is closed (flow stopped) and connection A-C is open (flow allowed) during the pauses between two successive injection processes, so that the second fuel is pumped by pump 9 in the circuit through an internal volume (injector volume V, and channel A-B) of injection nozzle 1, and thus this internal volume is flushed and filled completely with a second fuel.

At the beginning of the injection process, by switching solenoid valve 4, connection A-C is closed and connection A-D is opened, whereupon the first fuel, located in reservoir 2, flows into channel A-B and injects the second fuel located there and in injector volume V out of injection nozzle 1, opened by retracted nozzle needle 5, and into the Diesel engine. At this time, supply channel 12 to injector volume V is closed by check valve 7, so that the second fuel present in injector volume V cannot escape there.

The part of the internal volume of the injection nozzle 1 formed by channel A-B is larger than the maximum quantity of fuel injected by the injection nozzle during one injection process, so that it is always only the second fuel, present in the inner volume of injection nozzle 1 formed by injector volume V and channel A-B, that is injected, and not the first fuel flowing from reservoir 2. In other words, an interface I that is present between the first fuel delivered by reservoir 2 and the second fuel present in channel A-B of injection nozzle 1 at the beginning of the injection process, is displaced when connection A-D in solenoid valve 4 is opened, by the first fuel flowing from reservoir 2 in channel A-B from point A toward point B, but not so far that the first fuel that is flowing in channel A-B is injected with it into the engine.

At the end of the injection process, by closing connection A-D and opening connection A-C in solenoid valve 4, the circuit for the second fuel is restored and the internal volume of injection nozzle 1 is separated from the first fuel in reservoir 2 that is under high pressure. Check valve 7 in supply channel 12 then opens and the second fuel flows into injector volume V, and from there from point B through channel A-B, so that the first fuel located beyond interface I is forced along path A-C through solenoid valve 4 into the circuit of the second fuel, and mixed with the second fuel circulating therein. In this manner, the first fuel supplied by high-pressure pump 3 and passing through reservoir 2 in the operating mode described is supplied for combustion only by bypassing the second fuel flowing in the circuit, while the high pressure of the first fuel stored in reservoir 2 is utilized fully during the injection process.

In order to operate the engine on pure fuel, when starting or before shutoff or in operating states that require the use of pure fuel for example, either pump 9 can be disconnected and the engine operated exclusively on the first fuel delivered from reservoir 2, or the supply of the additional material insoluble in the fuel (water) from admixing means 10 can be interrupted; and the engine can be operated on the second fuel, in the form of pure fuel.

Water, a complete emulsion, or even Diesel fuel can be added to the circuit basically at any point, but preferably in the section between point E and pump 9. Since the injected volume initially is replaced during injection by fuel from the high-pressure reservoir, a quantity must also be removed from the circuit that is replaced to form a desired fuel composition with water or emulsified fuel. The volume subtracted, which is removed from the return line between point E and pump 9 for example, can be supplied to a separator 20 for example in which the emulsified fuel is broken down into its components of water and fuel. The separated components return to the circuit again through high-pressure reservoir 2 or through the water inlet. Separator 20 is connected by a throttle valve 22 provided in a line 21 whose throughput cross section can be adjusted as a function of the operating state, with a return line in the area between point E and pump 9.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A fuel injection method for a Diesel engine having an injection nozzle with an internal volume and with an engine injection location, said method comprising the steps of:

(a) selectively communicating a first supply channel containing a first fuel under pressure with the internal volume of said injection nozzle at a first supply location;

(b) selectively communicating a second supply channel containing a second fuel with the internal volume of said injection nozzle at two locations such that said second supply channel and said internal volume comprise a circuit, a first of said two locations being a second supply location located between said first supply location and said engine injection location, and a second of said two locations being a return location proximate said first supply location.

2. A fuel injection method according to claim 1, wherein said first fuel is supplied by a high-pressure pump and a reservoir.

3. A fuel injection method according to claim 1, further comprising the step of controlling the injection nozzle via a valve system to alternate steps (a) and (b).

4. A fuel injection method according to claim 1, wherein said second fuel comprises an emulsion of fuel and another substance insoluble in the fluid, said method further comprising the step of adjusting a mixture ratio of said fuel and said another substance.

5. A fuel injection method according to claim 1, wherein said first fuel is supplied to the internal volume of said injection nozzle in a first flow direction, and wherein the second fuel is supplied to the internal volume of said injection nozzle in a counter flow direction opposite to said first flow direction.

6. A fuel injection method according to claim 1, wherein said internal volume comprises an injector volume adjacent said engine injection location, and an injector channel communicated with said injector volume, said injector channel being larger than a maximum quantity of fuel injected, and wherein said first fuel is supplied to said injector channel.

7. A fuel injection method according to claim 5, wherein said internal volume comprises an injector volume adjacent said engine injection location, and an injector channel communicated with said injector volume, said injector channel being larger than a maximum quantity of fuel injected, and wherein said first fuel is supplied to said injector channel.

8. A fuel injection method according to claim 6, wherein said second fuel is supplied to said injector volume.

9. A fuel injection method for a Diesel engine having an injection nozzle with an internal volume, said method comprising the steps of:

supplying a first fuel under pressure to the internal volume of said injection nozzle;

supplying a second fuel to the internal volume of said injection nozzle, said second fuel comprising a pure fuel or an emulsion of fuel and another substance insoluble in the fuel; and controlling said injection nozzle with a two-way solenoid valve, said solenoid valve having a first position which communicates a supply source of the first fuel with the internal volume of the injection nozzle, and said solenoid valve having a second position which communicates a supply source of the second fuel with the internal volume of the injection nozzle.

10. A fuel injection method according to claim 5, further comprising the step of controlling said injection nozzle with a two-way solenoid valve, said solenoid valve having a first position which communicates the first supply channel with the internal volume of the injection nozzle, and said solenoid valve having a second position which communicates the second supply channel with the internal volume of the injection nozzle.

11. A fuel injection method according to claim 6, further comprising the step of controlling said injection nozzle with a two-way solenoid valve, said solenoid valve having a first position which communicates the first supply channel with the internal volume of the injection nozzle, and said solenoid valve having a second position which communicates the second supply channel with the internal volume of the injection nozzle.

12. A fuel injection method according to claim 1, wherein said second fuel is supplied to the internal volume of injector valve between two successive injection processes.

13. A fuel injection system for a Diesel engine, comprising:

an injection nozzle with an internal volume and with an engine injection location;

a first supply channel selectively communicable with the internal volume of the injection nozzle at a first supply location, a first fuel being supplied under pressure through said first supply channel;

a second supply channel selectively communicable with the internal volume of the injection nozzle at two locations such that said second supply channel and said internal volume comprise a circuit, a first of said two locations being a second supply location located between said first supply location and said engine injection location, and a second of said two locations being a return location proximate said first supply location, a second fuel being supplied through said second supply channel.

14. A fuel injection system according to claim 13, further comprising a high-pressure pump and a reservoir arranged in said first supply channel.

15. A fuel injection system according to claim 13, further comprising a valve system controllable to alternately connect said first supply channel and said second supply channel to said internal volume.

16. A fuel injection system according to claim 13, wherein said second fuel comprises an emulsion of fuel and another substance insoluble in the fluid, said system further comprising means for adjusting a mixture ratio of said fuel and said another substance.

17. A fuel injection system according to claim 13, wherein said internal volume comprises an injector volume adjacent said engine injection location, and an injector channel communicated with said injector volume, said injector channel being larger than a maximum quantity of fuel injected, and wherein said first supply channel is selectively communicable with said injector channel.

18. A fuel injection system for a Diesel engine having an injection nozzle with an internal volume, said system comprising:

a first supply channel communicated with the internal volume of the injection nozzle, a first fuel being supplied under pressure through said first supply channel;

a second supply channel communicated with the internal volume of the injection nozzle, a second fuel being supplied through said second supply channel, said second fuel comprising a pure fuel or an emulsion of fuel and another substance insoluble in the fuel; and a two-way solenoid valve, said solenoid valve having a first position which communicates said first supply channel with the internal volume of the injection nozzle, and said solenoid valve having a second position which communicates said second supply channel with the internal volume of the injection nozzle.

19. A fuel injection system according to claim 17, further comprising a two-way solenoid valve, said solenoid valve having a first position which communicates said first supply channel with the internal volume of the injection nozzle, and said solenoid valve having a second position which communicates said second supply channel with the internal volume of the injection nozzle.

20. A fuel injection system according to claim 18, wherein said internal volume comprises an injector volume adjacent a point of injection into the engine, and an injector channel communicating said injector volume with said solenoid valve.

21. A fuel injection system according to claim 13, wherein said second supply channel is arranged proximate said injector volume of injector nozzle, said system further comprising a check valve arranged in said second supply channel, said check valve configured to prevent fuel from flowing from the injector volume into said second supply channel.

* * * * *